United States Patent [19]

Betzmeir

[11] 4,184,731

[45] Jan. 22, 1980

[54] ELECTRICAL CONNECTOR FOR USE INSIDE A TUBE SUCH AS AN EJECTOR TUBE

[75] Inventor: Helmut Betzmeir, Ottobrunn, Fed. Rep. of Germany

[73] Assignee: Messerschmitt-Bölkow-Blohm GmbH, Munich, Fed. Rep. of Germany

[21] Appl. No.: 893,074

[22] Filed: Apr. 3, 1978

[30] Foreign Application Priority Data

Apr. 13, 1977 [DE] Fed. Rep. of Germany ... 7711455[U]

[51] Int. Cl.[2] ..... H01R 13/62

[52] U.S. Cl. ..... 339/45 M; 89/1.811; 339/176 M

[58] Field of Search ..... 339/45 R, 45 M, 75 R, 339/75 M, 176 R, 176 M; 89/1.811, 1.814

[56] References Cited

U.S. PATENT DOCUMENTS

| | | | |
|---|---|---|---|
| 720,103 | 2/1903 | Bonham | 339/75 R |
| 3,072,021 | 1/1963 | Marcon | 339/45 M |
| 3,761,865 | 9/1973 | Bomgaars et al. | 339/75 R |
| 4,047,464 | 9/1977 | Fredriksson et al. | 339/45 M |

FOREIGN PATENT DOCUMENTS

| | | | |
|---|---|---|---|
| 1172065 | 11/1969 | United Kingdom | 89/1.811 |

*Primary Examiner*—Joseph H. McGlynn
*Attorney, Agent, or Firm*—W. G. Fasse; D. F. Gould

[57] ABSTRACT

The present invention relates to an electrical connector designed for use inside a tube such as an ejector tube for the expulsion of bodies from the tube, whereby the electrical connector is ejected from the tube together with the respective body, such as a mine. As soon as the body leaves the tube, the connector automatically separates itself from the ejected body and falls apart. For this purpose the components of the electrical connector are so shaped that they cooperate for making electrical contact only inside the tube.

12 Claims, 2 Drawing Figures

Fig.1
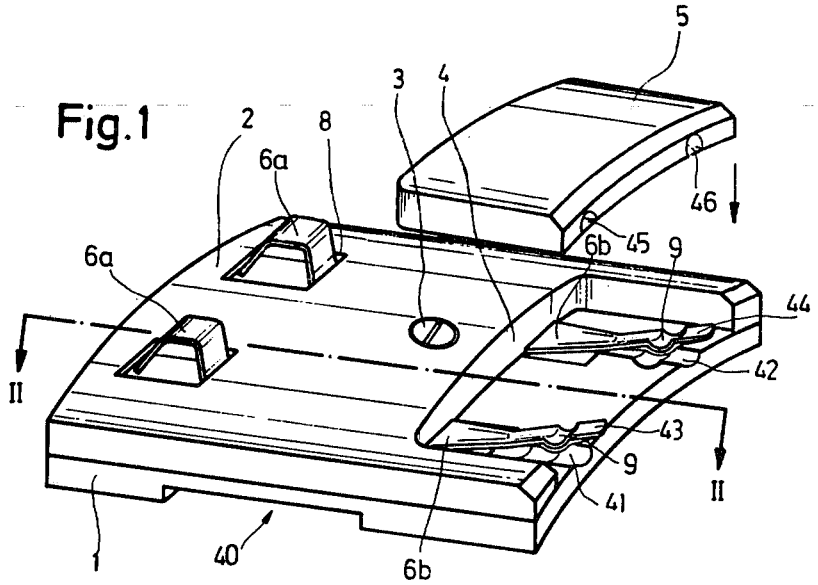
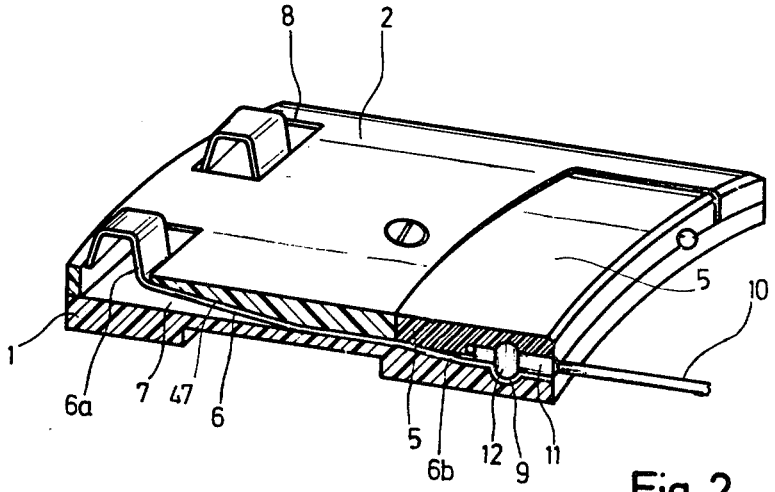
Fig.2

ELECTRICAL CONNECTOR FOR USE INSIDE A TUBE SUCH AS AN EJECTOR TUBE

BACKGROUND OF THE INVENTION

The present invention relates to electrical connectors for use inside a tube, such as an ejector tube. The connector is used inside the tube for connecting and disconnecting electrical circuits between a power source and bodies to be ejected from the tube. The ejector tube may, for example, be part of a mine laying container or scattering device.

It is customary to use plug type electrical connectors for wiring bodies located in ejector tubes, for example, the ejector tubes of a mine laying container. The electrical connection is released or opened when the body is ejected from the tube. The tension load effective on the body as it is being ejected, causes the interruption of the plug type connection.

German Patent Publication (DT-OS) No. 2,606,480 discloses a shearable electrical connection between a projectile and the container in which the projectile is located. The electrical connection is sheared off when the projectile, such as a missile is launched. At the time of separation the electrical connection is subjected to a load constituted by the superposition of a bending load and a tensile load so that the connection is interrupted at the point of shearing, whereby the projectile retains a smooth outer surface at the shearing or breaking locations.

However, such a superposition of forces for the purpose of shearing the electrical connection has the disadvantage that a tension or shearing force is applied to the projectile to be ejected or just having been ejected, whereby the trajectory of the projectile is influenced after the ejection. Further, since the container for scattering such bodies or projectiles comprises a plurality of such bodies or projectiles, it is possible that the scattering characteristics are influenced by said shearing in an undesirable manner which cannot be taken into account by prior calculations.

Another disadvantage of prior art devices is seen in that they generally require a cumbersome mounting of the electrical connection between the power source and the bodies contained in a scattering or so-called laying container, whereby the connecting piece is normally destroyed during the ejection of a body such as a projectile. Thus, if the scattering container is to be newly loaded, the entire electrical wiring must also be renewed.

OBJECTS OF THE INVENTION

In view of the above it is the aim of the invention to achieve the following objects singly or in combination:

to provide an apparatus of the type described above in which an easy assembly of the electrical connection is assured and which will disassemble itself automatically when the body has been ejected from the respective tube;

to provide an electrical connection which will not influence the trajectory of a body ejected from an ejector tube and which will also not adversely affect the scattering characteristics of a scattering or laying container;

to provide an electrical connector which is capable of being disassembled automatically and substantially without the application of any force to the connection so as to avoid applying tension or any other loads to the body being ejected; and to avoid the rewiring of a scattering container after reloading.

SUMMARY OF THE INVENTION

According to the invention there is provided an electrical connector for use inside a tube such as the ejector tube of a scattering container which is constructed to be ejected along with a body being ejected from such tube whereby the electrical connection or wiring is disconnected. The connector comprises an insulating housing which receives the contact components, including terminal members. The terminal members are located in a recess in the connector housing and a pressure plate fits into said recess to hold or establish the plug-in type connection or connections as long as the pressure plate is guided by the inner surface of the ejector tube. The pressure plate is lifted out of the recess automatically when the connector leaves the ejector tube. For this purpose the contacts or terminals may have a slight bias against the pressure plate radially outwardly. The pressure plate is preferably shaped so as to smoothly conform with its outer contour to the inner surface of the ejector tube.

The connector according to the invention is simply mounted by placing the terminal members in contact with each other and placing the pressure plate on top of the terminal members, whereupon the so assembled unit is placed into the ejector 2 which holds the respective contact or terminal members under pressure against each other and thus in electrical contact through the pressure plate. Just as soon as the connector is ejected, it is automatically disassembled, for example, by the respective air forces, or by a slight bias of the contact or terminal members. In any event, the pressure plate is lifted off the housing, whereby the contact members are separated from each other without any force being exerted on the projectile or body being ejected although prior to the lifting of the pressure plate, the contacts were firmly established in a force locking manner since the pressure plate was held by the tube in position in the connector housing. Thus, tension loads are not applied to the body being ejected so that its trajectory remains uninfluenced by the automatic disassemblying of the electrical connector.

BRIEF FIGURE DESCRIPTION

In order that the invention may be clearly understood, it will now be described, by way of example, with reference to the accompanying drawings, wherein:

FIG. 1 shows a perspective view of one embodiment of an electrical connector according to the invention with the pressure plate shown just prior to insertion into its respective recess;

FIG. 2 shows a sectional view along section lines II—II in FIG. 1 and with the pressure plate in its effective position, whereby the tube in which the connector is inserted is not shown for simplicity's sake;

DETAILED DESCRIPTION OF PREFERRED EXAMPLE EMBODIMENTS

Figure 3:
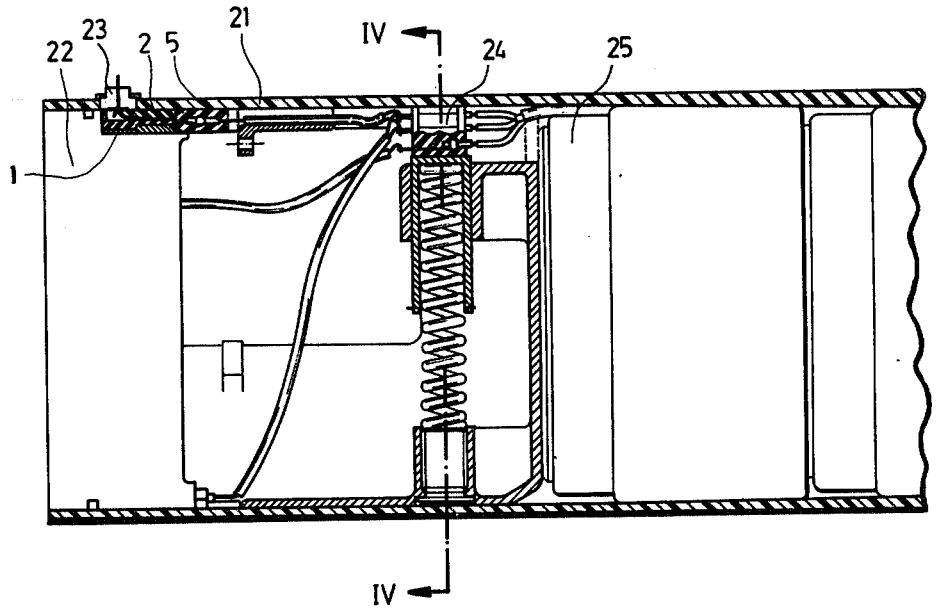
FIG. 3 is a sectional view through a tube into which another embodiment of an electrical connector according to the invention has been inserted; in addition, the figure also shows an electrical connector of the embodiment of FIG. 1 inserted in the tube.

An electrical connector according to the invention comprises as shown in FIG. 1, a housing 40 including a base plate 1 and a cover plate 2. Both plates 1 and 2 are made of insulating material and are connected to each other, for example, by means of a screw 3. The radially outwardly facing surface of the cover plate 2 forms part of a cylinder surface, whereby the radius of such cylinder surface corresponds to the inner radius of an ejector tube, for example, for mines or projectiles or the like.

The cover plate 2 is provided at one of its ends with a cut-out or recess 4 shaped to receive a correspondingly shaped pressure plate 5. The surface of the base plate 1 which faces the cover plate 2 and the pressure plate 5 is provided with channels or depressions 41 and 42 shaped to receive respectively formed tongues 43 and 44 forming first terminal means. The cover plate 5 is also formed with channels 45 and 46 to receive the conductors when the pressure plate 5 is in position as shown in FIG. 2.

In the inserted position the pressure plate 5 smoothly conforms to the contour of the cover plate 2 for insertion into an ejector tube 21 shown in FIG. 3. The terminal electrical contact tongues 43 and 44 are part of electrical contact means 6 held in position between the base plate 1 and the cover plate 2.

The portion 6*b* of the contact means may be slightly biassed radially outwardly as shown in FIG. 1. The opposite end of each contact is provided with a further terminal 6*a* having a bent configuration suitable for contacting a contact 23 operatively held in the wall of the tube 21 as shown in FIG. 3. The bent portion 6*a* may, for example, have the configuration of a half S-loop as shown.

For example, two contact means 6 may be held in each housing 40. These contact means extend substantially along the entire length of the housing. The cover plate is provided with holes 8 through which the terminal members 6*a* extend radially outwardly under a slight bias when the connector is not inserted into a tube 21.

The opening or hole 8 in the cover plate is deep enough so that the terminal end 6*a* of the contacts 6 may be recessed in the holes 8 to such an extent that the contact surface facing radially outwardly is flush with the surface of the cover plate 2. Further, the cover plate 2 is provided with an inwardly facing ramp portion 47 as best seen in FIG. 2, whereby the biassing of the contact ends 6*a* radially outwardly as well as their depression into the holes 8 is facilitated as best seen in FIG. 2.

The mentioned other free end or tongue portion 43, 44 of the contact means 6 is provided with a depression 9 fitting into a correspondingly formed depression in the base plate 1. These depressions are intended for cooperation with further contacts or second terminals 11 provided with a bulge 12 at the end of conductor wires 10. The bulge 12 which forms part of the terminal 11 prevents in cooperation with the respective depression 9, the withdrawal of the conductor 10 from the connector assembly as long as the pressure plate 5 is held in position by the tube 21. The inwardly facing surface of the pressure plate 5 is contoured, for example, with the channels 45 and 46 to accommodate the just described contact or terminal combination, whereby the disconnection of the terminals by way of a radial pull is prevented as long as the connector is located inside the tube 21.

Referring to FIG. 3 the present electrical connector is assembled by inserting the above mentioned components into a recess in a cover 22 of the ejector tube 21, whereby the surface of the cover plate 2 and the surface of the pressure plate 5 conforms smoothly to the inner surface of the ejector tube 21, whereby the connector is held in such a position that the contact members 6*a* of the contact means 6 cooperate with a contact 23 leading through the outer wall of the tube 21. The cable or electrical conductor 10, shown in FIG. 2, may either connect to a distributor device 24 which in turn in connected to the bodies to be ejected from the tube 21, or the conductor 10 may be directly connected to these bodies 25. The distributor device 24 is of similar construction as the connector so far described. In operation, the ejection of a body 25 from the tube 21 causes initially the cover 22 to leave the tube 21 first, whereby the connector is also removed out of the tube 21. As a result, the pressure plate 5 does not cause any force on the contact or terminal elements 43, 44 on the one hand, and 11, 12, on the other hand so that the electrical connection is now released without the application of any positive force. The bias of the contact portion 6*b* may be sufficient to remove the pressure plate 5 or even the wind forces may be sufficient for the removal of the pressure plate 5 as soon as the connector assembly has left the tube 21.

Figure 4:
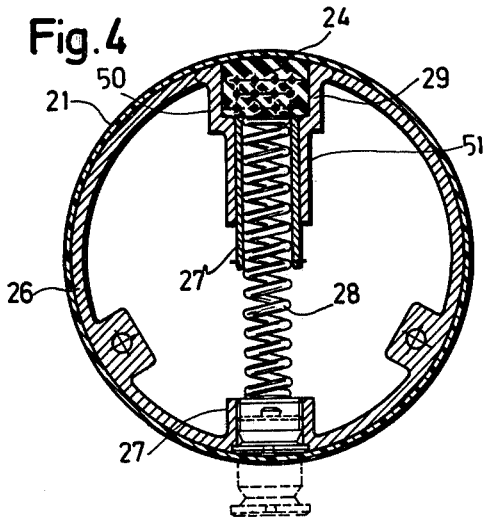
FIG. 4 is a sectional view through the tube along section line IV—IV in FIG. 3.
Figure 5:
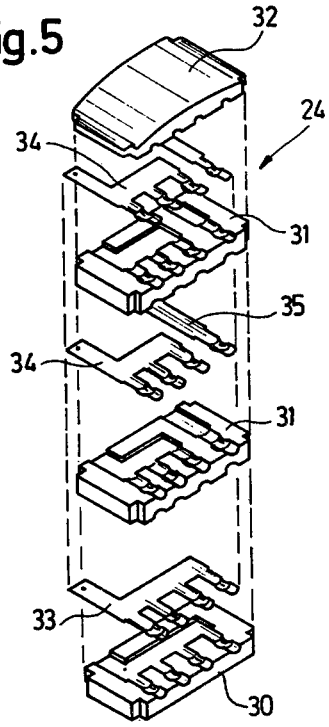
FIG. 5 illustrates a perspective, exploded view of the second embodiment of an electrical connector of the invention.

Referring specifically to FIGS. 4 and 5, the electrical distributor connector 24 is constructed similar as the connector described above, except that the distributor comprises a plurality of cooperating plates, namely, the base plate 30, a number of intermediate plates 31 and the cover plate 32 which functions simultaneously as the pressure plate. A plurality of contact elements 33, 34 and 35 are held between the several plates in the same manner as described above. The top or radially outer surface of the plate 32 is contoured so as to conform to the inner surface of the ejector tube 21. Thus, as long as the connector distributor 24 is held in position as shown in FIGS. 3 inside the tube, the electrical contacts are maintained as long as the ring 26 is located inside the tube 21.

The ring 26 is provided with a recess or hole 29 adjacent its circumference for receiving the assembled electrical distributor 24. The recess 29 is located in a bushing 50 merging into a radially inwardly extending sleeve 51 which holds a helical spring 28 for pressing the connector assenbly 24 radially outwardly against the inner surface of the tube 21. The recess 29 in the bushing 50 has a rectangular shape and has such a size that the assembly 24 fits lightly into the recess 29, whereby the assembly 24 is immediately ejected by the spring 28 as the connector assembly with the ring 26 leaves the tube 21.

Intermediate the individual plates the electrical contact members 33, 34, 35 correspond substantially in their shape to the contact members 6*b* illustrated in FIGS. 1 and 2. A plurality of such tongue type contact members may be connected to a common contact plate as shown in FIG. 5. The contact members shown in FIG. 5 also cooperate with the type of terminal shown at 11 and 12 in FIG. 2.

As best seen in FIG. 4, the spring 28 rests at its one end in a socket 27 and the other end may be held in a cap 27′ which slides for guidance in the sleeve 51. As long as the assembly 24 is in the recess 29 inside the tube 21, the spring 28 assures the proper electrical contacts as described. When the assembly leaves the tube 21, no force other than the force of the spring is required for disassemblying the connector assembly 24, whereby no forces are exerted on the body 25 which is ejected along with the contact assemblies.

Although the invention has been described with reference to specific example embodiments, it will be appreciated, that it is intended to cover all modifications and equivalents within the scope of the appended claims.

What is claimed is:

1. An apparatus for establishing electrical connections, comprising a hollow tube, electrical connector means including insulator housing means, electrical contact means extending through said insulator housing means, recess means in said housing means, said electrical contact means including terminal means extending into said recess means, and pressure plate means separably fitting into said recess means inside said hollow tube, electrical conductor means including further terminal means, said pressure plate means pressing said further terminal means against respective ones of said first mentioned terminal means to make said electrical connections inside said hollow tube and to automatically separate said electrical connections when said electrical connector means are ejected from said hollow tube without shearing or breaking.

2. The apparatus of claim 1, wherein said insulator housing means and said pressure plate means have a radially outer contour conforming to the inside of said hollow tube whereby said pressure plate means conforms to the outer contour of said insulator housing.

3. The apparatus of claim 1 or 2, wherein said insulator housing means comprises depression means in said recess means, said first mentioned terminal means having at least one portion shaped to fit into a respective depression means.

4. The apparatus of claim 1, wherein said insulator housing means (40) comprise a base plate (1) and a cover plate (2), said electrical contact means being located between said base plate and said cover plate, said housing means further comprising means (3) operatively connecting said base plate and said cover plate to each other to form said housing means.

5. The apparatus of claim 4, wherein said recess means are located in said cover plate to receive said pressure plate means, and wherein said electrical contact means are spring biased against said pressure plate.

6. The apparatus of claim 4, wherein said recess means comprise holes in said cover plate, said electrical contact means comprising bent contact members sticking radially outwardly out of said holes, said hollow tube comprising wall means and wall contact means inserted in said wall means, said bent contact members contacting said wall contact means when the connector is inside said tube.

7. The apparatus of claim 6, wherein said cover plate (2) has an inwardly facing ramp portion (47) slanting radially outwardly toward said holes (8), said bent contact members being biased radially outwardly, to normally rest against said ramp portion (47) and to stick out of said holes.

8. The apparatus of claim 7, wherein said bent contact member *(6a)* are shaped so as to be biased radially outwardly and projected into the respective one of said holes (8), when said connector is being ejected out of said tube.

9. The apparatus of claim 1, wherein said insulator housing means comprise a plurality of stacked plate members, said electrical contact means comprising a plurality of contact elements operatively held in position between said plate members to form a connector assembly.

10. The apparatus of claim 9, further comprising ring means slidingly fitting into said tube, said ring means having radially outwardly open hole means therein, wherein said connector assembly is received when said ring means are received in said tube.

11. The apparatus of claim 10, further comprising bushing means extending radially in said ring means and opening into said hole means, and spring bias means operatively located in said bushing means to bias said connector assembly radially outwardly against the inside of said tube when the connector assembly is located in said hole means in said ring means and the latter is located inside said tube.

12. The apparatus of claim 11, comprising futher bushing means arranged inside said ring means to face said first mentioned bushing means, said spring bias means comprising a helical spring held in said first and further bushing means.

* * * * *